US009920912B1

(12) United States Patent
Zhang et al.

(10) Patent No.: US 9,920,912 B1
(45) Date of Patent: Mar. 20, 2018

(54) LIGHTING DEVICE

(71) Applicants: Tian-Yong Zhang, Xiamen (CN); Fu-Sheng Liang, Xiamen (CN)

(72) Inventors: Tian-Yong Zhang, Xiamen (CN); Fu-Sheng Liang, Xiamen (CN)

(73) Assignee: Xiamen Konshine Lighting Co., Ltd, Xiamen, Fujian Province ( * ) Notice: Subject to any disclaimer, the term of this patent is extended or adjusted under 35 U.S.C. 154(b) by 0 days.

(21) Appl. No.: 15/632,304

(22) Filed: Jun. 24, 2017

(51) Int. Cl.

| | |
|---|---|
| ***F21V 21/00*** | (2006.01) |
| ***F21V 21/03*** | (2006.01) |
| ***F21V 21/02*** | (2006.01) |
| ***F21V 23/04*** | (2006.01) |
| *F21S 8/02* | (2006.01) |
| *F21V 21/08* | (2006.01) |

(52) U.S. Cl.
CPC ..... *F21V 21/03* (2013.01); *F21V 21/02* (2013.01); *F21V 23/04* (2013.01); *F21S 8/026* (2013.01); *F21V 21/0832* (2013.01)

(58) Field of Classification Search
CPC ..... F21V 21/03; F21V 21/02; F21V 23/04
USPC ..... 362/217.12
See application file for complete search history.

(56) References Cited

U.S. PATENT DOCUMENTS

| | | | | |
|---|---|---|---|---|
| 3,908,120 | A * | 9/1975 | Greene | F21V 21/02 362/457 |
| 3,985,417 | A * | 10/1976 | Fenton | H02G 3/20 439/334 |
| 6,343,873 | B1 * | 2/2002 | Eberhard | F21S 8/02 362/147 |
| 6,780,049 | B1 * | 8/2004 | D'Angelo | F04D 29/601 439/313 |
| 8,974,091 | B2 * | 3/2015 | Huang | F21V 19/0055 362/218 |
| 9,500,320 | B1 * | 11/2016 | Green | F21K 9/13 |
| 2002/0182917 | A1 * | 12/2002 | Kerr, Jr. | F21V 21/02 439/314 |
| 2008/0192489 | A1 * | 8/2008 | Ward | F21S 8/026 362/364 |
| 2011/0141741 | A1 * | 6/2011 | Engstrom | F21V 21/03 362/257 |
| 2012/0026744 | A1 * | 2/2012 | Peter | F21V 21/02 362/370 |
| 2012/0140490 | A1 * | 6/2012 | Rowlette, Jr. | F21K 9/00 362/373 |
| 2015/0131273 | A1 * | 5/2015 | Jackson | F21S 9/02 362/157 |
| 2016/0131346 | A1 * | 5/2016 | Creasman | F21S 8/03 362/145 |

* cited by examiner

*Primary Examiner* — Bryon T Gyllstrom

(57) ABSTRACT

A lighting device includes a mount, a first seat, a switch and a fixture. When the mount is connected to the fixture, the fixture contacts the switch to activate the circuit, and the second seat on the fixture, the light source and the first seat are electrically connected to the exterior power source. When the fixture is removed from the mount, the switch is shut off to protect the users from electrical hazard.

10 Claims, 12 Drawing Sheets

LIGHTING DEVICE

BACKGROUND OF THE INVENTION

1. Fields of the Invention

The present invention relates to a lighting device, and more particularly, to an interior lighting device.

2. Descriptions of Related Art

The conventional lighting device comprises a fixture which is connected to a wall or a ceiling, and is connected to the fixture and connected with a first connection portion and power components. A mount includes a second connection portion which is connected to the first connection portion so as to be connected with the fixture. The power components provide electric power to a light source. It is noted that when the fixture is connected to the wall or ceiling, the electric power is an operative circuit which is connected with the first connection, so that when the users connect the second connection portion to the first connection portion, the users may be under risk of electrical hazard. Alternatively, when the users unintentionally use a conductive tool to touch the circuit, the circuit may go short.

The present invention intends to provide a lighting device that is safe when assembling the fixture and the mount.

SUMMARY OF THE INVENTION

The present invention relates to a lighting device and comprises a mount, a first seat, a switch and a fixture. When the mount is connected to the fixture, the fixture contacts the switch to activate the circuit, and the second seat on the fixture, the light source and the first seat are electrically connected to the exterior power source. When the fixture is removed from the mount, the switch is shut off to protect the users from electrical hazard.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
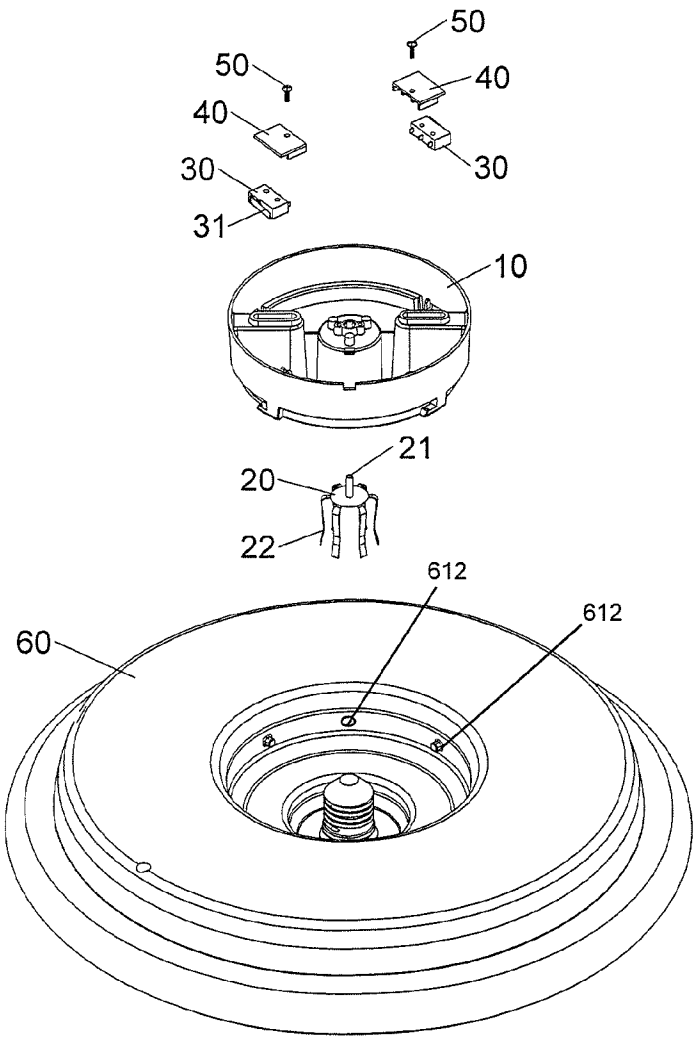
FIG. 1 is an exploded view of the lighting device of the present invention.
Figure 2:
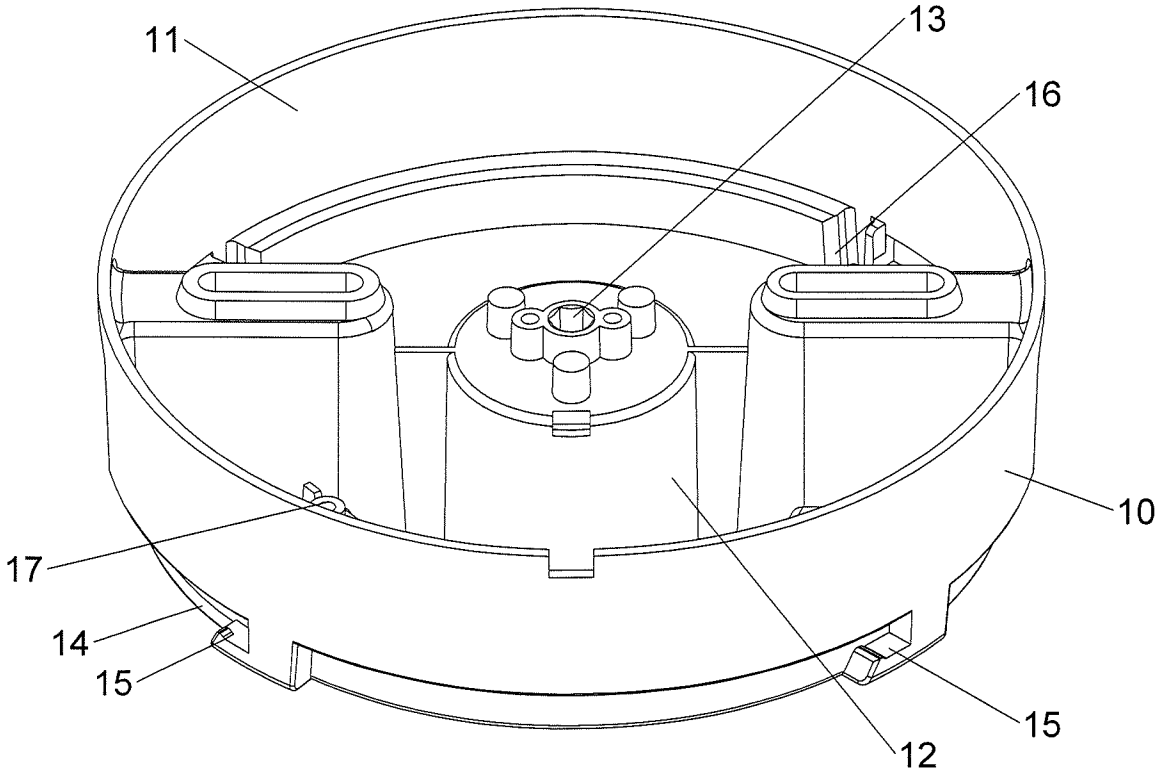
FIG. 2 is a perspective view to show the mount of the lighting device of the present invention.
Figure 3:
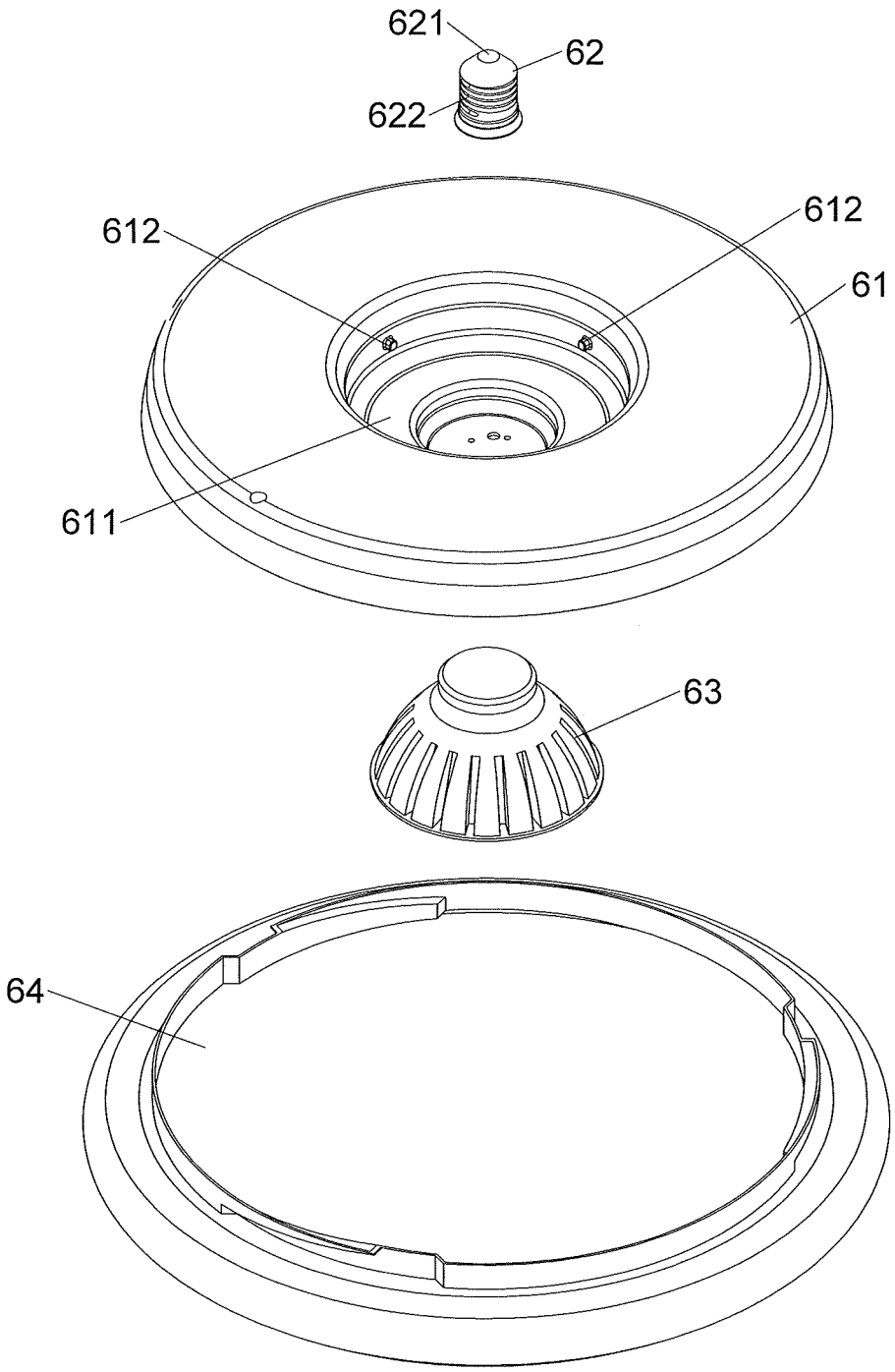
FIG. 3 is a perspective view to show the fixture of the lighting device of the present invention.
Figure 4:
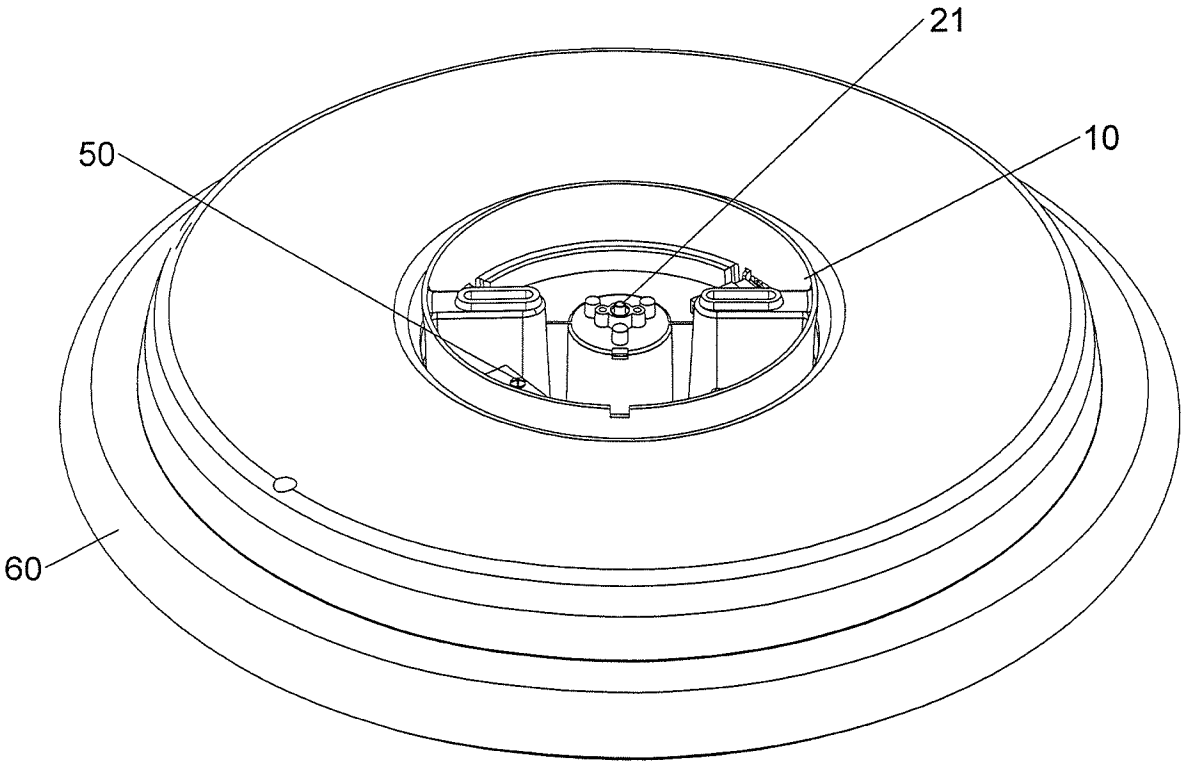
FIG. 4 is a perspective view to show the lighting device of the present invention.
Figure 5:
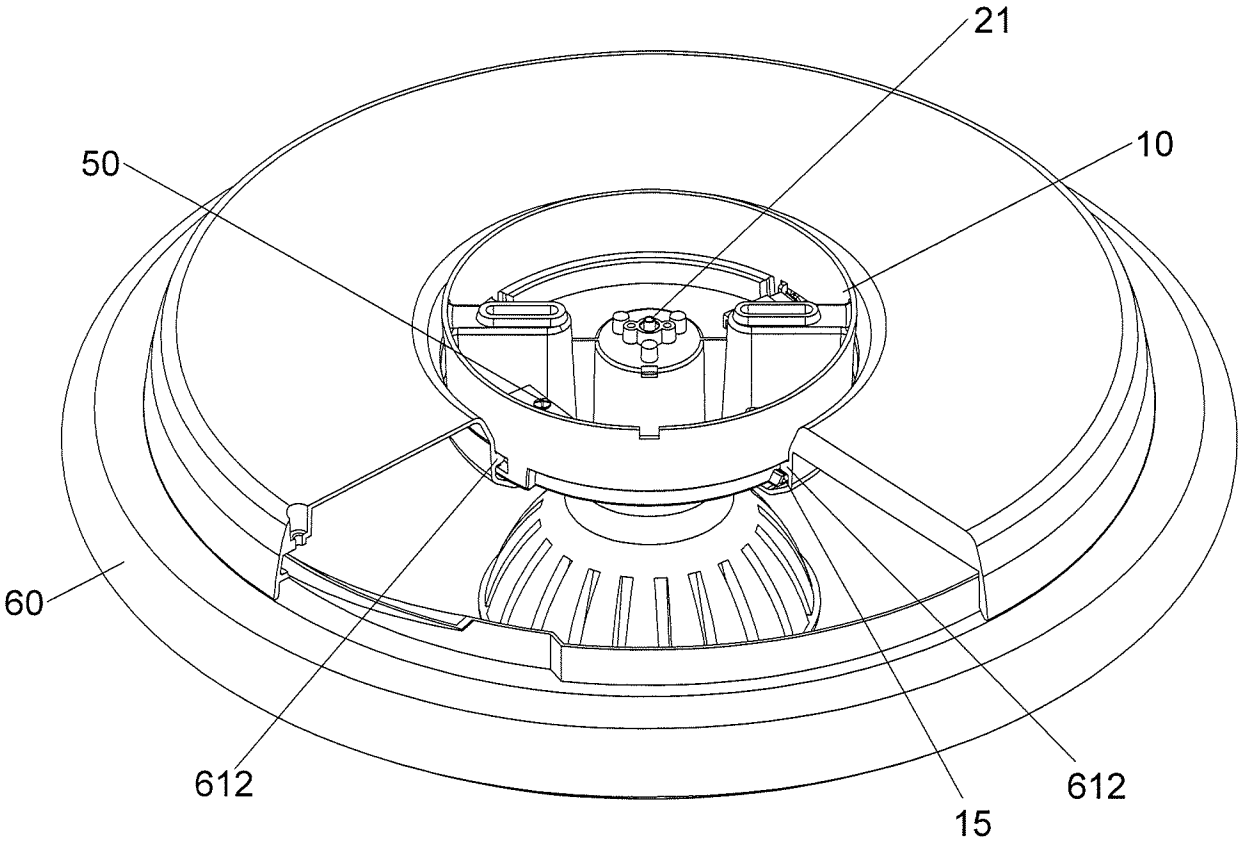
FIG. 5 is another perspective view to show the lighting device of the present invention.

Referring to FIGS. 1 to 6, the lighting device of the present invention comprises a mount 10, a first seat 20, two switches 30, at least one positioning member 40, two screws 50 and a fixture 60. The mount 10 is connected to a wall or a ceiling, and is a round mount with an open top. A room 11 is defined in the mount 10 so as to receive wires, a circuit board or other parts. A central part 12 is located at the center in the room 11 and includes a passage 13 defined axially therethrough. The passage 13 has a hexagonal a circular cross section. The mount 10 includes two penetrating slots 14 defined in the periphery thereof, and the penetrating slots 14 communicate with the room 11. Four L-shaped hooks 15 are formed on the periphery of the mount 10. Two of the four hooks 15 are located corresponding to the two penetrating slots 14. Two first connection portions 16 and two second connection portions 17 are located in the room 11. The two first connection portion 16 are located corresponding to the two penetrating slots 14 and the two second connection portion 17. The two first connection portion 16 are located between the two penetrating slots 14 and the two second connection portions 17. The two second connection portion 17 each include a threaded hole.

The first seat 20 is located in the central part 12 and has a first conductive portion 21 and a second conductive portion 22 in multiple pawl-shaped. The first conductive portion 21 extends through the passage 13. The two switches 30 are installed adjacent to the penetrating slots 14 and the first connection portions 16. The switches 30 each are a micro switch and have an activation member 31 which partially protrudes beyond the mount 10 via the penetrating slot 14 corresponding thereto. The switches 30 each are a micro-switch. The two positioning members 40 are respectively connected to the second connection portions 17 and the switches 30. The switches 30 are restricted by the positioning members 40 and are connected to the first connection portions 16. The two screws 50 extend through the positioning members 40 and are connected to the second connection portions 17 to connect the positioning members 40 to the second connection portions 17.

The fixture 60 is connected to the mount 10, and the fixture 60 touches the switches 30 via the penetrating slots 14 to activate the switches 30, such that first conductive portion 21 and the second conductive portion 22 of the first seat 20 are electrically connected to the exterior power source 70. When the fixture 60 is separated from the mount 10, the activation member 31 of each switch 30 is released, and the switches 30 are shut off. The circuit between the first and second conductive portions 21, 22 are cut off, so that the second conductive portion 22 cannot receive power from the exterior power source 70.

The fixture 60 includes a base 61, a second seat 62, a light source 63 and a shade 64. The base 61 includes a space 611 and multiple studs 612 extend from the inner periphery of the space 611. When the mount 10 is connected to the fixture 60, the hooks 15 are hooked to the studs 612. The studs 612 contact the switches 30 so as to electrically connect the first and second conductive portions 21, 22 to a circuit of the exterior power source 70. The second seat 62 is located in the space 611 and has a third conductive portion 621 and a fourth conductive portion 622. The third conductive portion 621 is connected to the first conductive portion 21, and the fourth conductive portion 622 is connected to the second conductive portion 22. The light source 63 and the base 61 are mounted to the second seat 62. The light source 63 is electrically connected to the third conductive portion 621 and the fourth conductive portion 622 so as to be electrically connected to the exterior power source 70. Therefore, the light source 63 located in the shade 64 is activated. In one embodiment, the first conductive portion 21 is connected to the fire line 71 of the exterior electric source 70. One terminal 300 of the switch 30 is connected to the ground line 72 of the exterior power source 70. The other terminal 301 is connected to the second conductive portion 22. The activation member 31 is pushed by the stud 612 to perform a bridge to connect the two terminals 300, 301.

Figure 7:
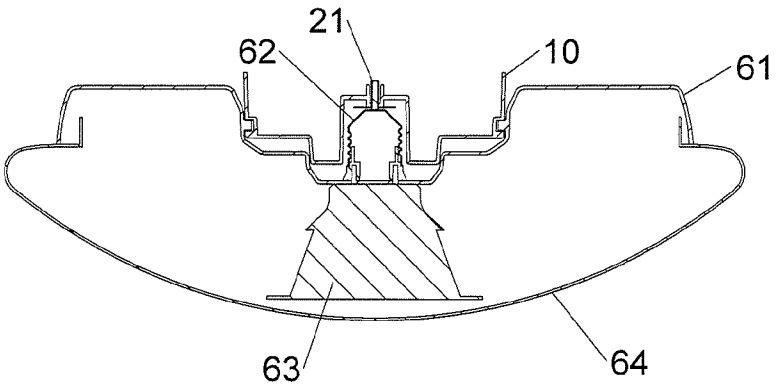
FIG. 7 is a cross sectional view, taken along line 7-7 in FIG. 6.
Figure 6:
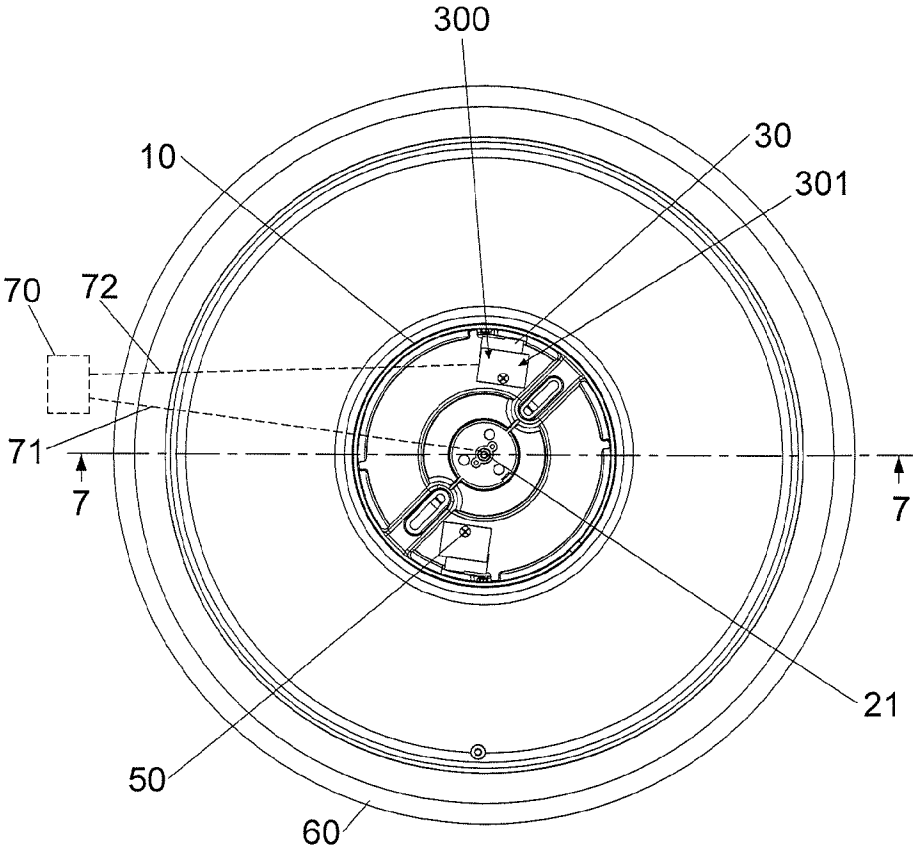
FIG. 6 is a top view of the lighting device of the present invention.

As shown in FIGS. 6 and 7, when the fixture 60 is connected to the mount 10, the second seat 62 is connected to the first seat 20, and the third and fourth conductive portions 621, 622 are respectively and electrically connected to the first and second conductive portions 21, 22. The first conductive portion 21 and the second conductive portion 22 are electrically connected to the exterior power source 70, so that the light source 63 lights up. The exterior power source 70 may be controlled by a switch.

Figure 9:
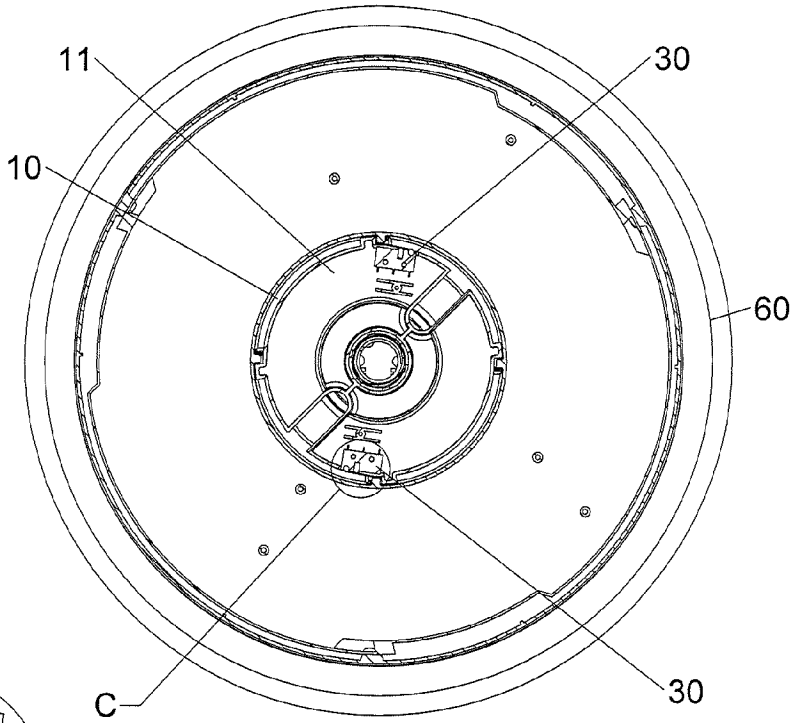
FIG. 9 is a cross sectional view, taken along line 9-9 in FIG. 8.
Figure 10:
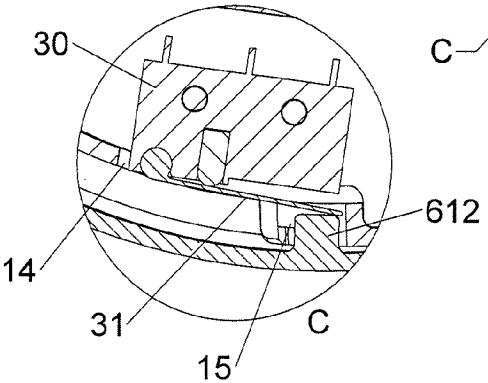
FIG. 10 is an enlarged view of the circled "C" in FIG. 9.
Figure 8:
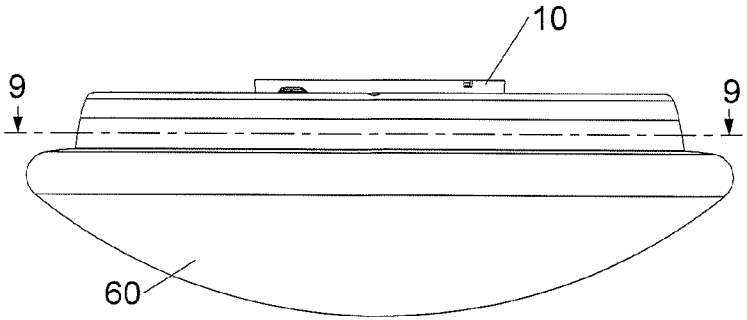
FIG. 8 is a front view of the lighting device of the present invention.

As shown in FIGS. 8 to 10, when the fixture 60 is rotated relative to the mount 10 to engage the studs 612 with the hooks 15, the studs 612 touch the activation members 31 that extend beyond the penetrating slots 14 to activate the switches 30. The first, second, third and fourth conductive portions 21, 22, 621, 622 and the light source 63 are electrically connected.

Figure 11:
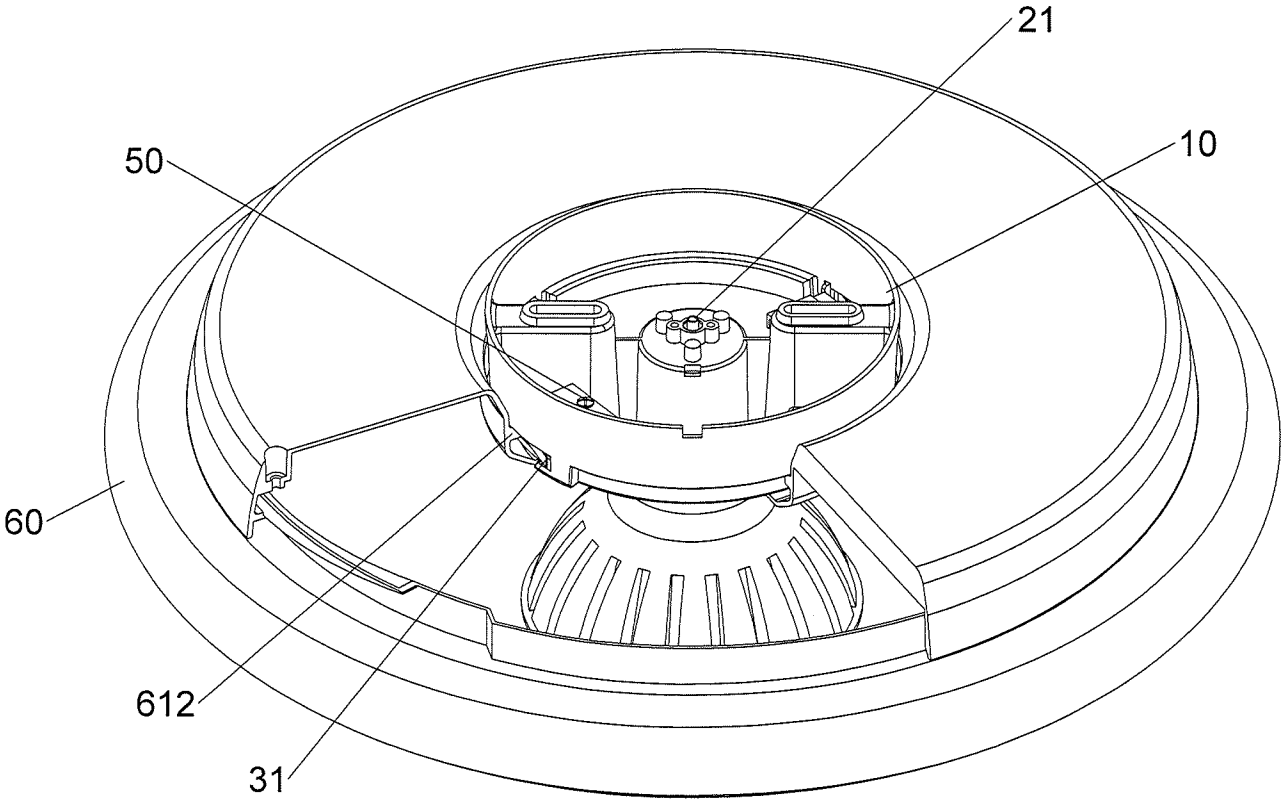
FIG. 11 shows the second operative status of the lighting device of the present invention.
Figure 12:
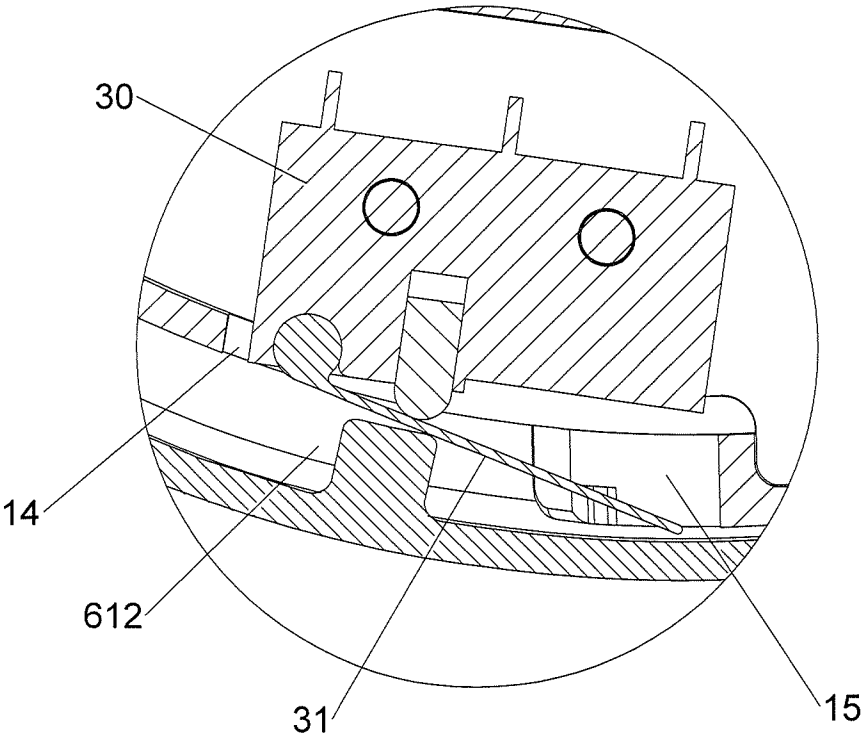
FIG. 12 is an enlarged cross sectional view to show the stud is located relative to the activation member of the switch.
Figure 13:
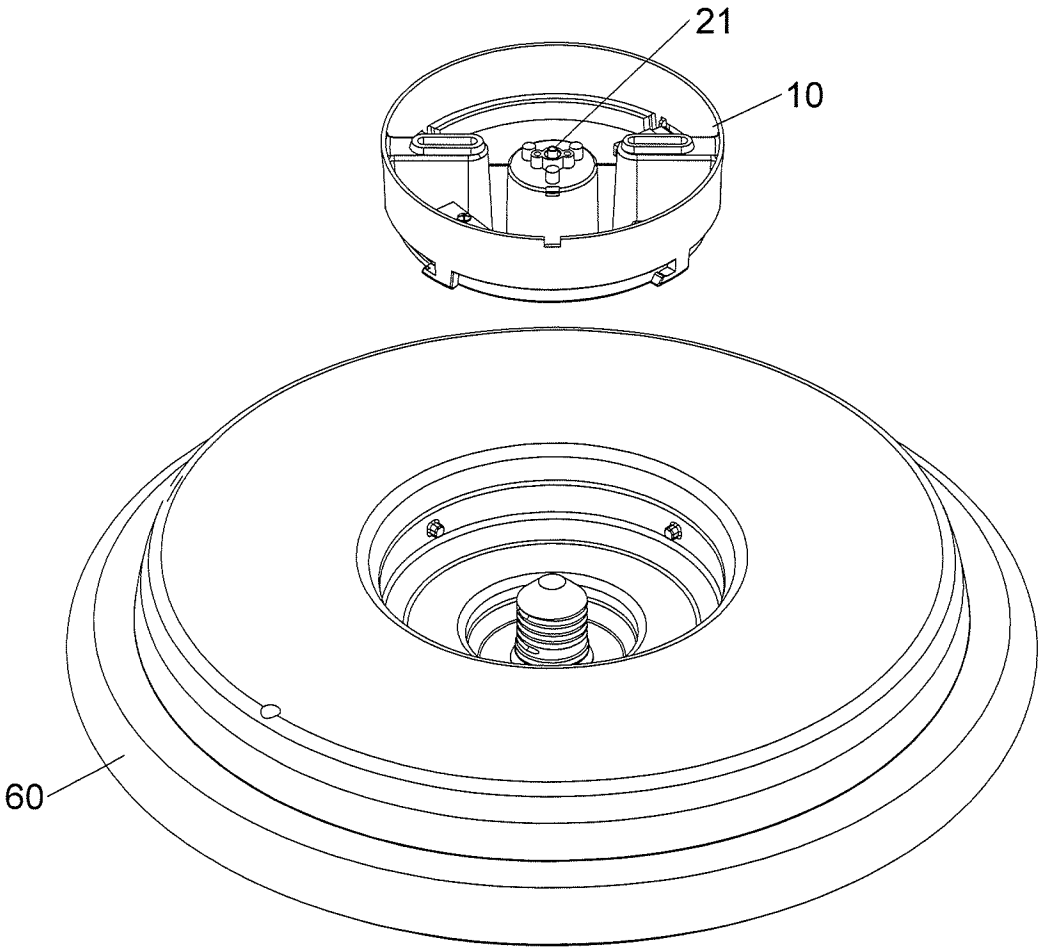
FIG. 13 shows that the mount is separated from the fixture of the lighting device of the present invention.

As shown in FIGS. 11 to 13, when the fixture 60 is rotated and separated from the mount 10, the studs 612 are disengaged from the hooks 15. The activation members 31 are not pushed by the studs 612, so that the switches 30 are shut off. The circuit between the first and second conductive portions 21, 22 is cut off, and the fixture 60 is separated from the mount 10.

Figure 15:
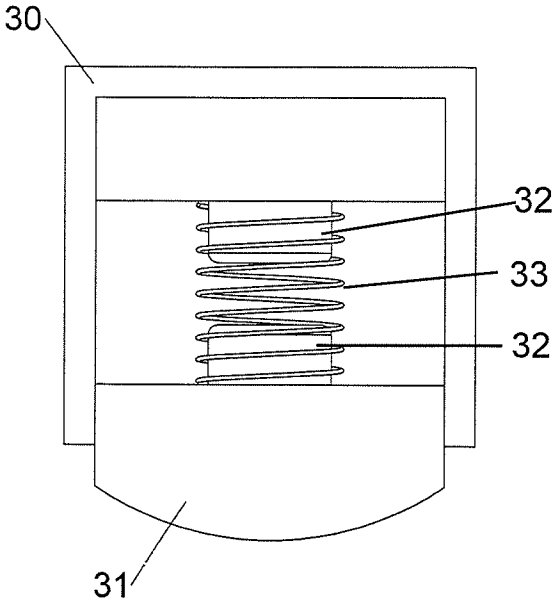
FIG. 15 is a top view of the switch in the second embodiment of the lighting device of the present invention.
Figure 14:
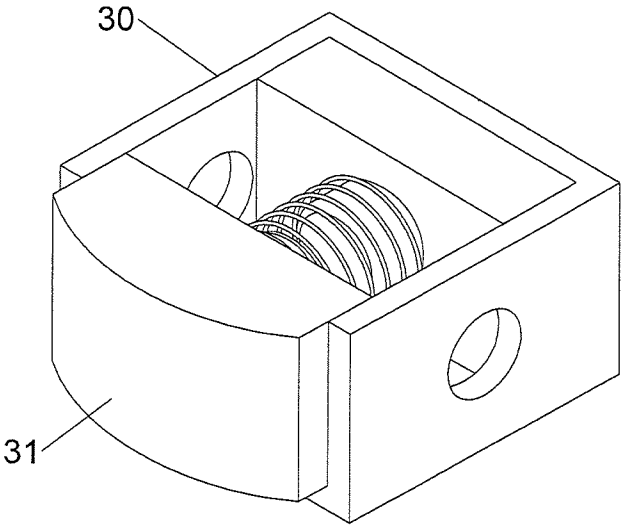
FIG. 14 shows the switch in the second embodiment of the lighting device of the present invention.

As shown in FIGS. 14 and 15, the switches 30 each include two conductive protrusions 32 and a resilient member 33 which is biased between the two protrusions 32. When the switches 30 are in contact with the studs 612, the resilient members 33 are compressed, and the two protrusions 32 are in contact with each other to activate the switches 30.

Figure 16:
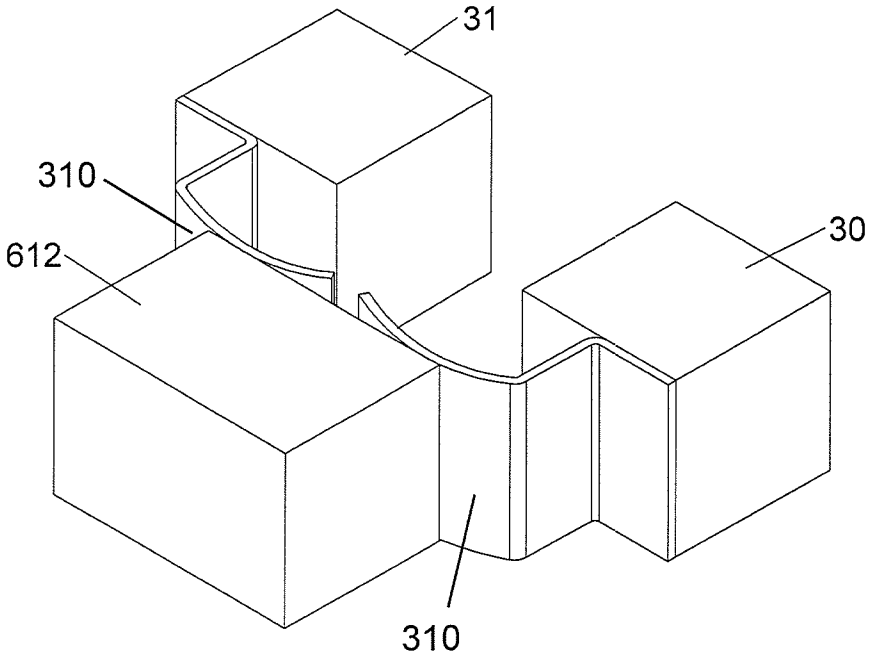
FIG. 16 shows the stud contacts the two conductive plates to activate the switch.

As shown in FIG. 16, the switches 30 each include two conductive plates 310 spaced apart from each other. The studs 612 are conductive so that when the studs 612 contact the two conductive plates 310, the switch 30 is activated.

Another embodiment of the present invention shows that there are eight studs 612 evenly located along a circle (referring to FIGS. 1 and 2), and there are four hooks 15 even located along a circle. The embodiment has two penetrating slots 14 and two switches 30. The hooks 15 and the penetrating slots 14 are separated from each other by 45 degrees. Each hook 15 is hooked with one stud 612, and the other two studs 612 are used to touch the two switches 30.

Yet another embodiment shows that the mount 10 and the fixture 60 each are cylindrical, rectangular or pentagonal or any known shape.

The advantages of the present invention are that when the fixture 60 is connected to the mount 10, the studs 612 are connected with the hooks 15 and push the switches 30 to let the first, second, third and fourth conductive portions 21, 22, 621, 622 and the light source 63 be electrically connected to the exterior power source 70. When the fixture 60 is separated from the mount 10, the switches 30 are shut off so as to protect the users from electrical hazard.

When rotating the fixture 60 relative to the mount 10, the studs 612 are separated from the hooks 15, so that the fixture 60 are separated from the mount 10, and the switches 30 are shut off.

While we have shown and described the embodiment in accordance with the present invention, it should be clear to those skilled in the art that further embodiments may be made without departing from the scope of the present invention.

What is claimed is:

1. A lighting device comprising:

a mount having a room defined therein, a central part located at a center in the room and including a passage defined axially therethrough, the mount including at least one penetrating slot defined in a periphery thereof, the at least one penetrating slot communicating with the room, multiple hooks formed on the periphery of the mount, at least one first connection portion and at least one second connection portion located in the room, the at least one first connection portion located corresponding to the at least one penetrating slot and the at least one second connection portion, the at least one first connection portion located between the at least one penetrating slot and the at least one second connection portion;

a first seat located in the central part and having a first conductive portion and a second conductive portion, the first conductive portion extending through the passage;

at least one switch located close to the at least one penetrating slot and the at least one first connection portion, the at least one switch partially protruding beyond the mount via the at least one penetrating slot;

at least one positioning member connected to the at least one second connection portion and the at least one switch, the at least one switch being restricted by the at least one positioning member and connected to the at least one first connection portion;

a fixture including a base, a second seat and a light source, the base including a space and multiple studs extending from an inner periphery thereof, when the mount is connected to the fixture, the hooks are hooked to the studs, at least one of the studs contacts the at least one switch so as to electrically connect the first and second conductive portions to a circuit of an exterior power source, when the studs are separated from the hooks, the at least one of the studs is separated from the at least one switch to shut off the at least one switch, the first and second conductive portions are not electrically connected to the circuit of the exterior power source, and the second seat located in the space and having a third conductive portion and a fourth conductive portion, the third conductive portion connected to the first conductive portion, the fourth conductive portion connected to the second conductive portion, the light source and the base connected to the second conductive portion, the light source electrically connected to the third conductive portion and the fourth conductive portion so as to be electrically connected to the exterior power source.

2. The lighting device as claimed in claim 1, wherein the mount is a round mount with an open top, the mount is adapted to be connected to an object, at least one wire and a circuit are received in the room, the central part is a cylindrical part and the passage has a hexagonal cross section.

3. The lighting device as claimed in claim 1, wherein the at least one penetrating slot includes two penetrating slots, the multiple hooks are four hooks and arranged as a circle, the two penetrating slots are located corresponding to two of the four hooks.

4. The lighting device as claimed in claim 1, wherein the at least one second connection portion includes a threaded hole, at least one screw extends through the at least one positioning member and is connected to the at least one second connection portion to connect the at least one positioning member to the at least one second connection portion.

5. The lighting device as claimed in claim 1, wherein the at least one switch is a micro-switch.

6. The lighting device as claimed in claim 1, wherein the at least one penetrating slot is located at an inner side of the hook corresponding thereto, when the hooks are hooked to the studs, at least one of the studs contacts the at least one switch.

7. The lighting device as claimed in claim 1, wherein the fixture includes a shade which is translucent and connected to the base, the light source is located in the shade.

8. The lighting device as claimed in claim 1, wherein the at least one switch includes two conductive protrusions and a resilient member which is biased between the two conductive protrusions, when the at least one switch is in contact with the one of the studs, the resilient member is compressed, and the two conductive protrusions are in contact with each other to activate the at least one switch.

9. The lighting device as claimed in claim 1, wherein the at least one switch includes two conductive plates spaced apart from each other, the studs are conductive so that when the studs contact the two conductive plates of the at least one switch, the at least one switch is activated.

10. The lighting device as claimed in claim 1, wherein a number of the studs is larger than a number of the hooks, a portion of the studs is hooked by all of the hooks, the rest portion of the studs contacts the at least one switch which is activated.

* * * * *